US005187326A

United States Patent [19]

Shirai

[11] Patent Number: 5,187,326

[45] Date of Patent: Feb. 16, 1993

[54] DEVELOPING APPARATUS

[75] Inventor: Masanari Shirai, Chigasaki, Japan

[73] Assignee: Canon Kabushiki Kaisha, Tokyo, Japan

[21] Appl. No.: 767,693

[22] Filed: Sep. 30, 1991

[30] Foreign Application Priority Data

Sep. 28, 1990 [JP] Japan ..... 2-260018

[51] Int. Cl.[5] ..... G03G 15/09

[52] U.S. Cl. ..... 118/657; 355/215; 355/251

[58] Field of Search ..... 118/657, 658; 355/215, 355/251, 260

[56] References Cited

U.S. PATENT DOCUMENTS

| | | | |
|---|---|---|---|
| 3,982,498 | 9/1976 | Wilcox | 118/637 |
| 4,373,468 | 2/1983 | Suda et al. | 118/658 |
| 4,387,664 | 6/1983 | Hosono et al. | 118/658 |
| 4,616,919 | 10/1986 | Adley et al. | 355/245 |
| 4,843,421 | 6/1989 | Fox | 355/215 X |
| 5,084,733 | 1/1992 | Katoh et al. | 355/251 |

*Primary Examiner*—Michael L. Gellner

*Assistant Examiner*—P. J. Stanzione

*Attorney, Agent, or Firm*—Fitzpatrick, Cella, Harper & Scinto

[57] ABSTRACT

A developing apparatus includes a container for containing a developer including magnetic particles. A rotatable developer carrying member is disposed in the container and faced to an image bearing member, for carrying the developer to a developing zone. A magnet is provided in the developer carrying member, and a magnetic sealing member is disposed adjacent to and in a rotational direction of the developer carrying member in a region inside of the container adjacent a longitudinal end of the developer carrying member, wherein the magnetic sealing member cooperates with the magnet to form a magnetic field effective to form a magnetic brush of the developer between the magnetic sealing member and the developer carrying member, and wherein an outer end, with respect to the longitudinal direction of the developer carrying member, of the magnetic sealing member is disposed in a range between 2 mm outwardly away from an end of the magnet and 1 mm inwardly away therefrom.

5 Claims, 5 Drawing Sheets

DEVELOPING APPARATUS

FIELD OF THE INVENTION AND RELATED ART

The present invention relates to a developing apparatus for developing an electrostatic latent image which is formed on an image bearing member through an electrophotographic process or an electrostatic recording process. More particularly it relates to a developing apparatus using a one component magnetic developer or a two component developer containing magnetic carrier particles and toner particles.

In a developing apparatus using a one component developer or a two component developer to develop an electrostatic latent image which is formed on an image bearing member through the electrophotographic or electrostatic recording process, developer contained in the container is carried to a developing zone on a non-magnetic sleeve containing therein a magnet.

In such a developing apparatus, in order to prevent leakage of the developer through longitudinal end portions of the sleeve, an elastic sealing member such as felt, moltplane or the like is provided at an end portion of the sleeve (U.S. Pat. No. 4,373,468).

However, with a conventional elastic sealing member, the developer, although the amount is small, enters the space between the elastic sealing member and the peripheral surface of the developing sleeve. The developer is rubbed against the sleeve and forms fine coagulations, which are returned to the container. If this occurs, a developed image is deteriorated.

If the close contact between the elastic seal and the sleeve surface is increased to prevent the leakage of the developer, the problems arise, such as an increase in the rotational torque of the developing sleeve or fusing of the developer due to the temperature rise stemming from the rubbing between the developing sleeve and the elastic seal.

In order to solve these problems, a proposal has been made in which magnetic sealing means having a magnetic sealing member disposed at each of the developing sleeve end portions with a predetermined clearance therebetween (U.S. Ser. Nos. 499,729 and 562,658).

The magnetic sealing means is advantageous in that it does not impose mechanical overload to the developer, and therefore, coagulation or fusing can be avoided. Also, the rotational torque required by the sleeve is small. However, the following problems have been found if it is used for a long term.

FIG. 1 shows an arrangement wherein a magnetic sealing member 9*a* is disposed inside, with respect to the longitudinal direction of the sleeve, of a longitudinal end surface 5'*a* of the magnetic roller 5*a* in the developing sleeve 5*b*. The developer is sealed by a magnetic brush which is formed by cooperation between the magnetic member 9*a* and the magnet 5*a* in the developing sleeve 5*b*. However, a small amount of the developer 6 is deposited on the developing sleeve surface at a position corresponding to an end surface of the magnet 5*a* by the magnetic force of the magnet 5*a* adjacent the end surface 5'*a*. If the device is used for a long term in this state, the developer 6 is accumulated into a thick layer on the developing sleeve outer surface at the position T corresponding to the end surface 5'*a* of the magnet. The thick layer of developer results in deposition of the developer onto an image bearing member 100, and further, to a transfer sheet.

FIG. 2 shows an arrangement wherein the magnetic sealing member 9*a* is disposed outside, with respect to the longitudinal direction of the sleeve, of an end surface 5'*a* of the magnet roller 5*a*. In this case, the developer 6 may be brought out of the magnet influential region of the magnet 5*a* by the magnetic force between the end surface 5'*a* of the magnet 5*a* and the magnetic member 9*a*. If this occurs, the developer sealing effect is deteriorated.

SUMMARY OF THE INVENTION

Accordingly, it is a principal object of the present invention to provide a developing apparatus provided with magnetic sealing means to effectively prevent leakage of the developer at an end of a developer carrying member for a long term.

It is another object of the present invention to provide a developing apparatus provided with magnetic sealing means capable of preventing accumulation of the developer at a position outside the magnetic sealing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 3:
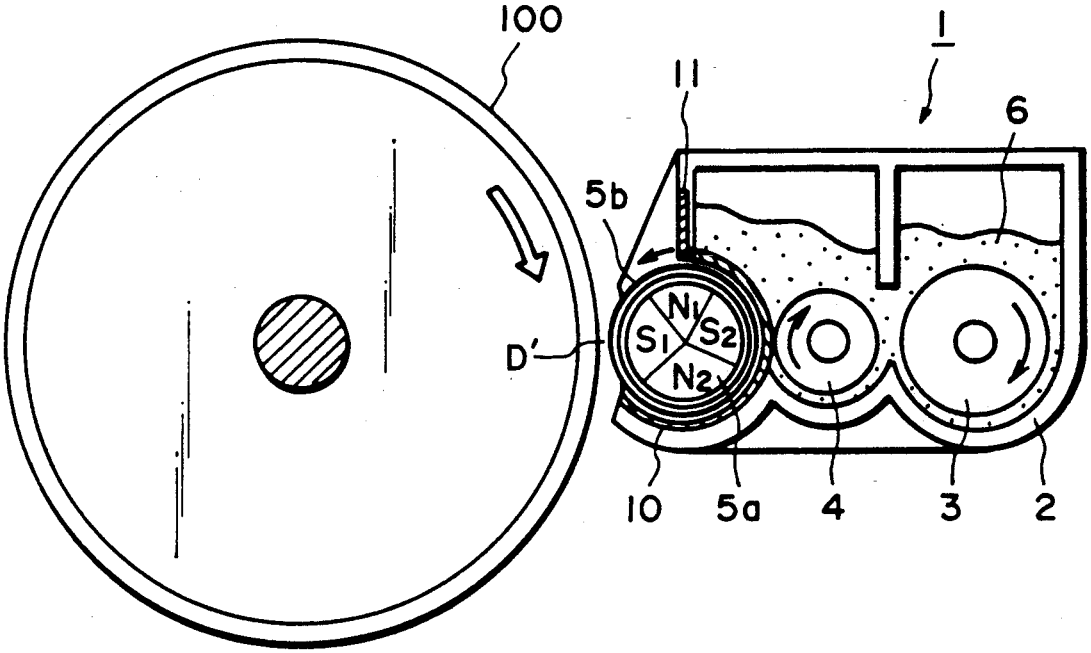
FIG. 3 is a sectional view of a developing apparatus according to an embodiment of the present invention.

Referring to FIG. 3, there is shown a developing apparatus 1 which is provided with a developer container 2 for containing a developer 6 which may be a magnetic toner, that is, a one component magnetic toner comprising magnetic particles kneaded in a resin material, or a two component developer comprising magnetic carrier particles mainly composed of magnetic particles and toner particles.

In order to develop in a developing zone D an electrostatic latent image on an image bearing member 100 formed by a known (not shown) latent image forming means, a developer carrying member, that is, a developing sleeve 5*b* made of non-magnetic material such as aluminum or stainless steel is provided in the container 2. The developing sleeve 5*b* is rotatable in the direction indicated by an arrow. In the developing sleeve 5*b*, as shown in FIG. 3 a permanent magnet roller 5*a* is non-rotatably disposed. The magnet is magnetized as shown in FIG. 3. The magnet is effective to attract the developer to the surface of the developing sleeve by the magnetic force thereof. In the developer container 2, conveying screws 3 and 4 are disposed to supply the developer to the developing sleeve 5b.

Figure 4:
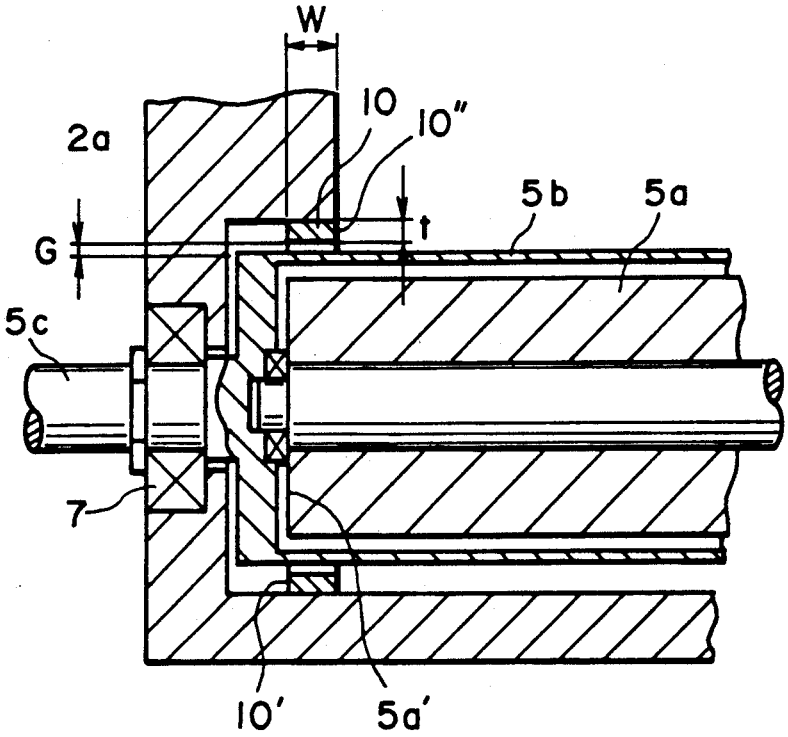
FIG. 4 is a sectional view of a major part of the developing apparatus according to an embodiment of the present invention.

As shown in FIG. 4, the developing sleeve 5b has a shaft 5c which is supported by the bearings 7 in the side walls 2a (only one side wall 2a is shown in FIG. 4) of the developer container. It is rotationally driven by a driving source (not shown).

A regulating blade 11 is made of magnetic material such as steel and is faced to the sleeve 5b with a small clearance at a position corresponding to a magnetic pole N1 to regulate a layer of the developer 6 formed on the sleeve 5b. On the developing sleeve 5b, a thin layer of the developer to be conveyed to the developing zone D is formed. The regulation of the developer layer thickness by the converged magnetic field from the magnetic pole N1 to the magnetic blade 11 is disclosed in U.S. Pat. No. 4,387,664. A magnetic pole S1 is provided as a developing pole to provide a foggy background preventing magnetic field in the developing zone D.

A magnetic pole N2 functions to take the remaining developer after the development into the developer container 2. A magnetic pole S2 functions to magnetically attract the developer in the container 2 to the sleeve 5b.

In such a developing apparatus, without the sealing means at the opposite longitudinal ends of the sleeve, the developer 6 moves also in the longitudinal direction of the developing sleeve 5b with the result of leakage of the developer to the developing sleeve bearings 7 and the developer container side walls 2a.

Figure 5:
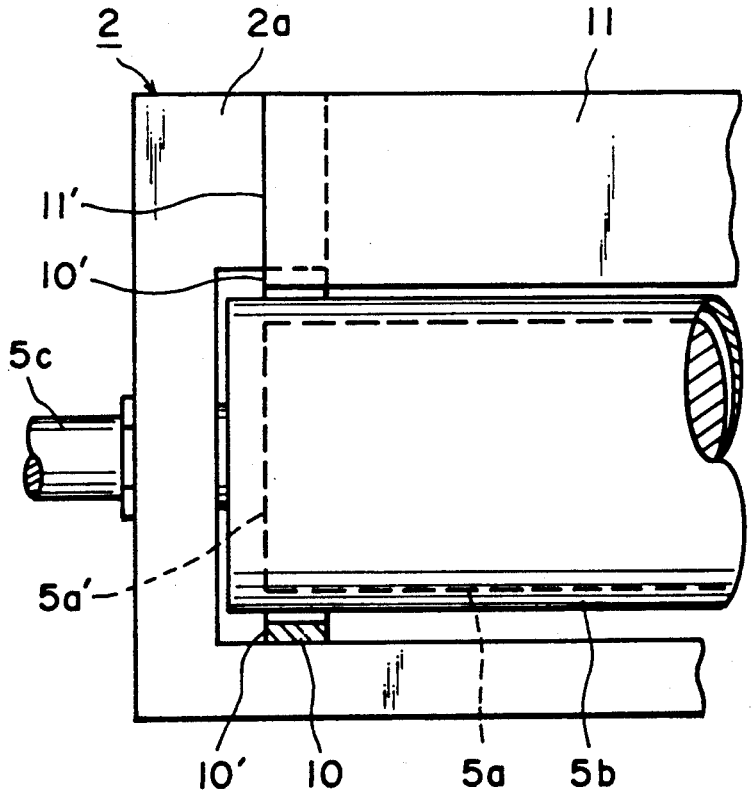
FIG. 5 is a front view thereof.
Figure 6:
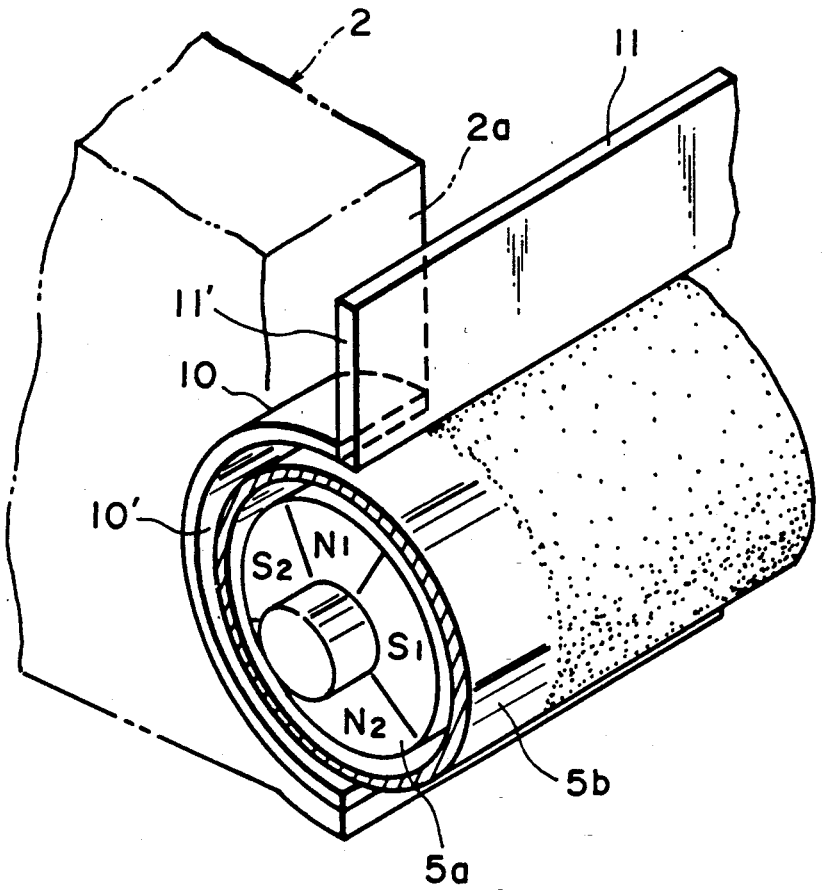
FIG. 6 is a perspective view thereof.

Referring to FIGS. 4, 5 and 6, the developer sealing means will be described. FIGS. 4, 5 and 6 are a sectional view, a front view and a perspective view of an end of the developing sleeve 5b. The magnet roller 5a in the developing sleeve 5b has a length which is larger than a width of a latent image formation area (to be developed by the developing zone) measured in the direction of the length of the sleeve 5b. The sealing member 10 constituting the developer sealing means has an outside end surface 10' which is located at substantially the same longitudinal position as an end surface 5'a of the magnet 5a, and an inside end surface 10'' located at the longitudinal position which is substantially the same as the inside surface of the developer container wall 2a. It is in a magnetic plate having a width W. It is fixed on-the side wall 2a of the container. Here, the end surface of the magnetic sealing member is an end surface in the longitudinal direction of the sleeve 5b, and the outside end surface is an end surface which is closer to the longitudinal end surface of the sleeve 5b. The other surface is the inside end surface.

A clearance G is formed between the sealing member 10 and the outside surface of the developing sleeve 5b, and the sealing member 10 is curved along the outer surface of the developing sleeve 5b so as to enclose the end outer surface of the developing sleeve 5b in the container 2. In the shown Example, the sealing member 10 is concentric with the magnet 5a.

The sealing member 10 is in the form of a plate having a thickness (t) of 0.5 mm–2 mm and is made of steel, nickel, magnetic stainless steel or another ferromagnetic material. The clearance G between the sealing member 10 and the outer surface of the developing sleeve 5b is 0.3–0.7 mm.

Figure 7:
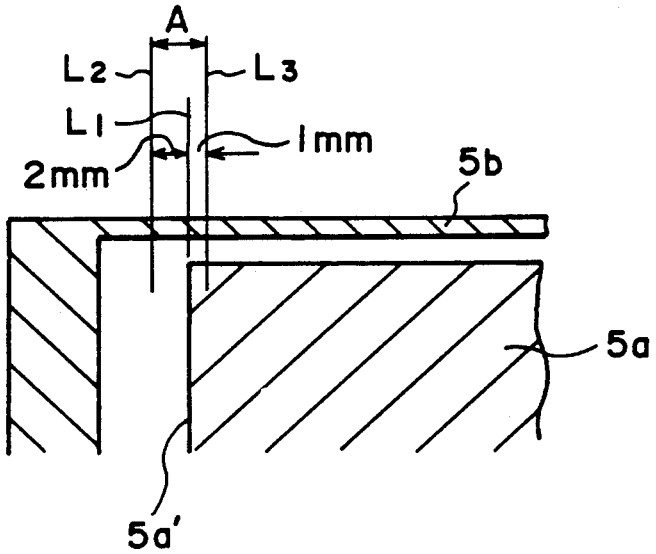
FIG. 7 is an enlarged sectional view thereof.

An outside end surface 10' of the magnetic sealing member 10 is preferably at a position of the end surface 5a' of the magnet 5a with respect to the longitudinal direction of the sleeve 5b (on line L1 in FIG. 7). However, the outer end surface 10' of the magnetic sealing member 10 is effectively disposed in a range A of −1 mm–2 mm from an end surface 5a' of the magnet 5a toward the developing sleeve bearing 7 in consideration of the dimensional accuracy and assembling accuracy or the like of the developing sleeve 5b and the magnet 5a. Such arrangement is effective to solve the problems described in conjunction with FIGS. 1 and 2.

That is, the outer end surface 10' of the magnetic sealing member 10 is disposed within a range between a line L2 (FIG. 7) and a line L3, wherein the line L2 corresponds to 2 mm away from the end surface 5a' of the magnet 5a toward outside in the sleeve longitudinal direction, and the line L3 is 1 mm away therefrom toward inside.

On the other hand, the inside surface of the sealing member 10 is substantially flush with the internal surface 2a of the developer container. However, this is not limiting.

Figure 8:
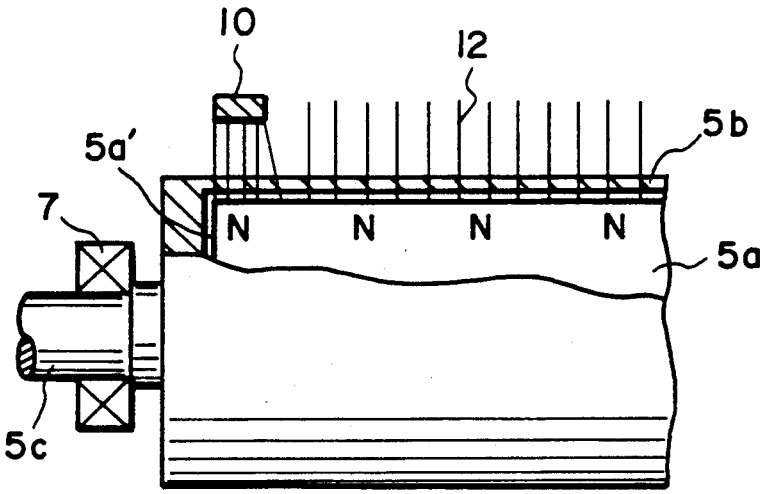
FIG. 8 illustrates magnetic lines of force according to an embodiment of the present invention.

FIG. 8 shows the direction of the magnetic lines of force 12 of the magnet 5a when the magnetic sealing member 10 is disposed in accordance with the present invention. The magnetic sealing member 10 is magnetized by the magnet 5a, and the magnetic lines from the end of the magnet 5a are concentrated on the magnetic sealing member 10. The magnetic lines of force from the end surface 5'a of the magnet 5a and the neighborhood thereof are substantially normal to the surface of the sleeve 5b, and the production of the magnetic field component tending to move the developer toward outside of the end surface 5a', is suppressed.

Figure 1:
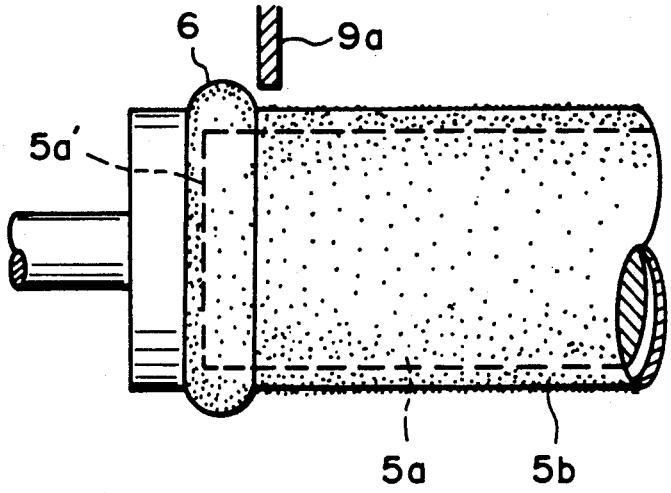
FIG. 1 illustrates an example of problems with conventional magnetic sealing means.
Figure 2:
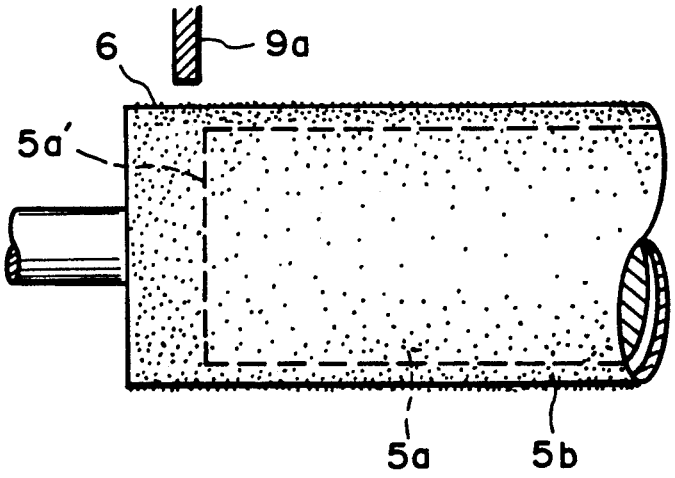
FIG. 2 illustrates another problem with conventional magnetic sealing means.
Figure 9:
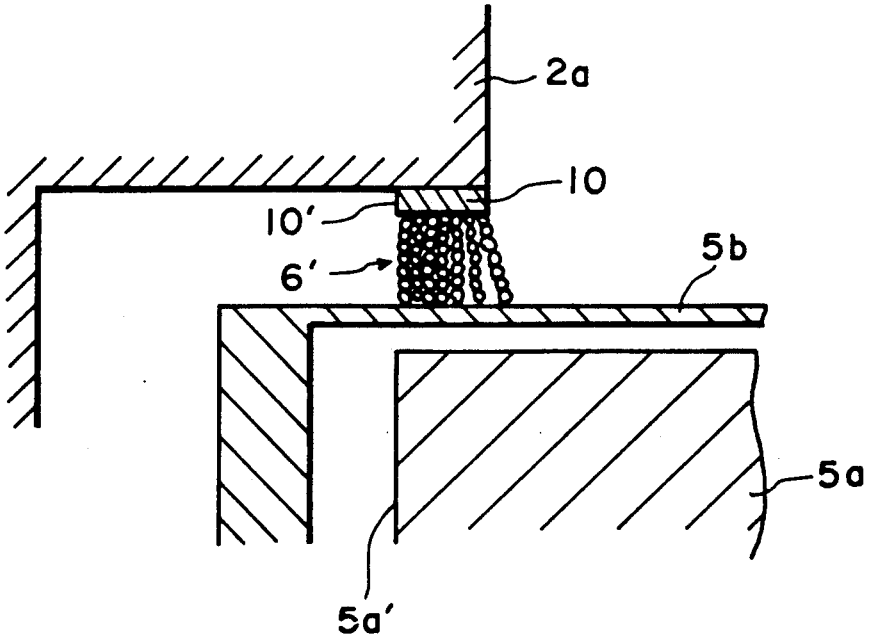
FIG. 9 illustrates a magnetic brush in an apparatus according to an embodiment of the present invention.

As shown in FIG. 9, by the magnetic field, a magnetic brush 6' of the developer is formed in the clearance between the magnetic sealing member 10 and the sleeve 5b. The magnetic brush 6' is not easily moved outside beyond a position corresponding to the end surface 5a' of the magnet 5b for the reasons described above. Therefore, the inconveniences described in conjunction with FIGS. 1 and 2, are prevented.

The magnetic brush 6' fills in the clearance between the sleeve 5b and the magnetic sealing member 10, and functions to prevent the developer in the container 2 from leaking to the end surface of the sleeve. No strong mechanical stress is imparted to the developer as a result of the leakage prevention, and therefore, production of a fine coagulation or fusing of the developer can be prevented.

As shown in FIG. 5, it is preferable that the magnetic blade 11 for regulating the developer on the developing sleeve 5b and for forming a thin layer of the developer on the developing sleeve 5, is so disposed that the end surface 5a' of the magnet 5a is aligned with the end surface 11' of the regulating blade 11 in the longitudinal direction. In this case, the entire length of the magnet 5a is equal to the entire length of the blade 11. However, in consideration of assembly tolerances, it is preferable that the end surface 11' of the blade 11 is within the region A of FIG. 7. Further, it is preferable that the end surface 11' of the blade 11 is aligned with the end surface 10' of the magnetic sealing member 10 in the direction of the length of the sleeve.

In the manner described in the foregoing, the production of a magnetic field tending to move the developer outwardly beyond the end surface 5a' of the magnet 5a at an end portion 11' of the blade 11 is overcome.

In the Figures, only one end portion of the sleeve is shown, but the sealing means has the same structure in the other end portion.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus, comprising:

a container for containing a developer comprising magnetic particles;

a rotatable developer carrying member in said container and faced to an image bearing member, for carrying the developer to a developing zone;

a magnet in said developer carrying member;

a magnetic sealing member disposed proximate to and in a rotational direction of said developer carrying member in a region inside said container and adjacent a longitudinal end of said developer carrying member, wherein said magnetic sealing member cooperates with said magnet to form a magnetic field effective to form a magnetic brush of the developer between said magnetic sealing member and said developer carrying member, and wherein an outer end, with respect to the longitudinal direction of said developer carrying member, of said magnetic sealing member is disposed in a range between 2 mm outwardly away from an end of said magnet and 1 mm inwardly away therefrom.

2. An apparatus according to claim 1, wherein a bearing for rotatably supporting said developer carrying member is disposed outside said magnetic sealing member in the longitudinal direction.

3. An apparatus according to claim 2, wherein a clearance between said magnetic sealing member and said developer carrying member is 0.3–0.7 mm.

4. An apparatus according to claim 1, 2 or 3, further comprising a regulating member for regulating a thickness of a layer of the developer to be conveyed to the developing zone by said developer carrying member, said regulating member having a longitudinal end disposed in a range between 2 mm outwardly away from the end of said magnet and 1 mm inwardly away therefrom.

5. An apparatus according to claim 4, wherein said regulating member is composed of magnetic material, and is disposed on a side of said developer carrying member opposite a magnetic pole of said magnet.

* * * * *

UNITED STATES PATENT AND TRADEMARK OFFICE

CERTIFICATE OF CORRECTION

PATENT NO. : 5,187,326

DATED : February 16, 1993

INVENTOR(S) : SHIRAI

It is certified that error appears in the above-identified patent and that said Letters Patent is hereby corrected as shown below:

COLUMN 1

Line 10, "particularly" should read --particularly,--.
Line 55, "surface 5'a" should read --surface 5a'--.
Line 64, "surface 5'a" should read --surface 5a'--.
Line 67, "T" should be deleted; and "surface 5'a" should read --surface 5a'--.

COLUMN 2

Line 6, "face 5'a" should read --face 5a'--.
Line 7, "magnet influential" should read --magnet-influential--.
Line 9, "surface 5'a" should read --surface 5a'--.
Line 66, "FIG. 3" should read --FIG. 3,--.

COLUMN 3

Line 43, "surface 5'a" should read --surface 5a'--. --direction--.

Signed and Sealed this

First Day of February, 1994

Bruce Lehman

*Attest:*

BRUCE LEHMAN

*Attesting Officer*

*Commissioner of Patents and Trademarks*